US005102169A

United States Patent [19]

Mayfield

[11] Patent Number: 5,102,169

[45] Date of Patent: Apr. 7, 1992

[54] MEDICATION MANAGEMENT SYSTEM

[75] Inventor: Mary E. Mayfield, Santa Fe, N. Mex.

[73] Assignee: M M & K, Inc., Santa Fe, N. Mex.

[21] Appl. No.: 576,613

[22] Filed: Aug. 31, 1990

[51] Int. Cl.[5] ..... B42D 15/00

[52] U.S. Cl. ..... 283/115; 283/117; 283/900

[58] Field of Search ..... 283/81, 900, 66.1, 115, 283/117; 40/600; 281/45

[56] References Cited

U.S. PATENT DOCUMENTS

| | | | |
|---|---|---|---|
| 630,822 | 8/1899 | Bates | 283/81 |
| 4,235,459 | 11/1980 | Callahan | 283/81 X |
| 4,287,676 | 9/1981 | Weinhaus | 40/600 X |
| 4,614,360 | 9/1986 | Sheehan et al. | 281/45 |
| 4,654,101 | 3/1987 | Kane | 40/600 X |
| 4,815,767 | 3/1989 | Lambert | 283/900 X |

OTHER PUBLICATIONS

Exhibit A: Marking Pens and Pencils.

Exhibit B: Variety of Pin-Thumbtacks.

"Dispenser" for Vitamins, Pills or Food Supplements, described as item F1297 on p. 17 of the Autumn 1990 *Walter Drake* magazine.

"Medicine Chest" described as item 0723-6 on p. 35 of the *Miles Kimball* catalog.

$R_X$ Minder (Model RX-1/Product Number 060011) *Healthcheck Presciption Minder.*

Items described on pp. 11, 12, 14, 17, 19-21, 29, 350 of *Apothecary Products*, Winter of 1989 catalog.

*Primary Examiner*—Joseph M. Gorski
*Assistant Examiner*—Peter Dungba Vo
*Attorney, Agent, or Firm*—Deborah A. Peacock; Donovan F. Duggan

[57] ABSTRACT

The disclosure is directed to a chart listing medications, dosage times, and notes. Tactile and visual medication symbols and marking elements denote specific times for taking specific medications. Medication containers are similarly marked.

59 Claims, 5 Drawing Sheets

MEDICATION MANAGEMENT SYSTEM

COPYRIGHT

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

This invention relates to a system for aiding people, particularly the elderly and ill, in administration of multiple medications.

2. Description of the Related Art Including Information Disclosed under 37 C.F.R. §§1.97–1.99 (Background Art)

Because of advances in medicine and today's powerful new drugs, people are living longer. A major problem confronted daily by people, particularly elderly and chronically ill patients, is home implementation of the necessary drug regimen in a safe, accurate, and timely manner. Errors and misuse can undermine the effectiveness of these drugs and can indeed be dangerous to the patient.

In many instances, the patient's drug regimen includes up to six or more medications to be taken daily, each medication having its own timetable and dosage, and each with accompanying instructions and warnings. The effort to keep track of such a complexity of information can be confusing and threatening to the patient, causing distress and often prolonging recovery.

Charts currently in use by medical professionals are often difficult for anyone outside the profession to read and understand. Many patients are already disquieted simply by being ill and can become additionally concerned or confused with the added burden of having to follow the doctor's orders. Apprehension over possible misuse of the prescribed drugs and other medications only serves to cause further distress.

"Homemade" systems are often unworkable for multiple medications as they can become very complicated and confusing to the patient. Moreover, when the doctor makes changes to the regimen, the system may have to be completely revamped.

Plastic box containers work only for those using relatively few medications; they will not accommodate a large multiplicity of medications (e.g. six to twelve medicines) to be taken several times daily, seven days a week., and, of course, the medication must be in pill form to be placed in the slots of the plastic containers. Systems such as these are not useful for medications that are sensitive to light or air. Neither are they practical for the use of patches or salves.

SUMMARY OF THE INVENTION (DISCLOSURE OF THE INVENTION)

The present invention relates to a medication management system. This system comprises a chart which includes: names of medicines to be taken by a patient which are marked on the chart, coded symbols marked or disposed on the chart which correspond to the medicines (marked on the chart) to be taken by the patient; times of the day (marked, printed, or otherwise disposed on the chart) for the medicines to be taken by the patient; and medication marking elements disposed on the chart, the medication marking elements corresponding to the coded symbols and positioned on the chart in such a manner to indicate the time of the day at which the medicines are to be taken by the patient. The coded symbols are preferably positioned adjacent the names of medicines marked on the chart.

In the preferred embodiment, the coded symbols comprise distinctive varying shapes, such as circles, square, triangles, diamonds, crosses, rectangles, stars, and the like, for designating corresponding various medicines to be taken by the patient. Each medication marking element is preferably substantially identical in shape to its corresponding coded symbol for designating each particular medicine to be taken by the patient.

Also in the preferred embodiment, the coded symbols are coded via varying colors for designating various medicines to be taken by the patient. Likewise, each medication marking element should be substantially identical in color to its corresponding coded symbol for designating each particular medicine to be taken by the patient.

The medication marking elements may comprise pins, marks made by marking pencils or pens, magnetic marker elements, tacks and the like. The medication marking elements preferably comprise raised elements.

The chart may further comprise "notes" for recording information pertaining to the various medicines to be taken by the patient.

The chart may comprise laminated sheets, preferably with the uppermost laminated sheet comprising a plastic surface so that marks can be easily erased. In an embodiment with a clear plastic surface, the sheet underlying the clear plastic surface would comprise the coded symbols and preferably horizontal rows and vertical columns so that the names of the medicines and the times of the day for the medicines to be taken by the patient can be easily marked on the uppermost clear plastic surface.

In the preferred laminated embodiment, the chart comprises a ferrous material or magnetic material so that magnetic marking elements may be attached to the chart surface. The bottommost layer of the chart may comprise a magnetic material (e.g. magnetized or unmagnetized ferromagnetic particles in a plastic binder). Or the chart may comprise a ferromagnetic sheet layer, on the back or as an inner layer. The chart may be relatively rigid or flexible.

Preferably, the medication marking elements are removably attachable to the chart. These elements may be erasable marks made by a marking pen or pencil. Likewise, the names of medicines and the times for taking the medicines may be inscribed on the chart using marking pens or pencils. The marking pens or pencils are preferably color coded for the purposes described above. Alternatively, the times of the day for the medicines to be taken by the patient may be printed numerals disposed on the chart.

The medication management kit of the invention comprises the chart and components described above, along with tabs for marking medication containers. The tabs correspond to the coded symbols and the medication marking elements. The tabs are preferably adhesive tabs for easy attachment to the medicine containers. The tabs are preferably color coded and shaped, such as the medication marking elements and coded symbols to assist in identification of the medicine to be taken at a particular time.

The kit of the invention may further comprise marking pens or pencils, also preferably color coded, for marking, for example, the names of medicines to be taken by the patient, the coded symbols, the times of the day, and the medication marking elements. The kit may further comprise a sponge for erasing such marks.

An object of the present invention is to provide significant assistance in the proper usage of multiple medications, particularly for elderly people.

Another object of the present invention is the provision of tactile and visual identification of multiple medications.

An advantage to the present invention is that it is sensitive to the elderly or chronically ill patient's difficulties with eyesight, coordination, and memory loss.

Yet another advantage is that it is simple, affordable, and easy to manufacture and use.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED EMBODIMENTS OF THE INVENTION (BEST MODES FOR CARRYING OUT THE INVENTION)

The present invention comprises an organized system to aid the elderly and infirm, as well as caregivers and nursing professionals, in the proper use and management of multiple medications. The present invention helps establish and maintain individual daily dosages with a simple, changeable system suited to each patient's particular needs. The term "patient," as used throughout the specification and claims, means any persons, or even animals, requiring a medical management system. The terms "medicine" and "medication," as used throughout the specification and claims, mean prescription and non-prescription drugs, vitamins, supplements, herbs, foods, bandages or other wraps, first aid devices, cleansing solutions, and the like.

Figure 1:
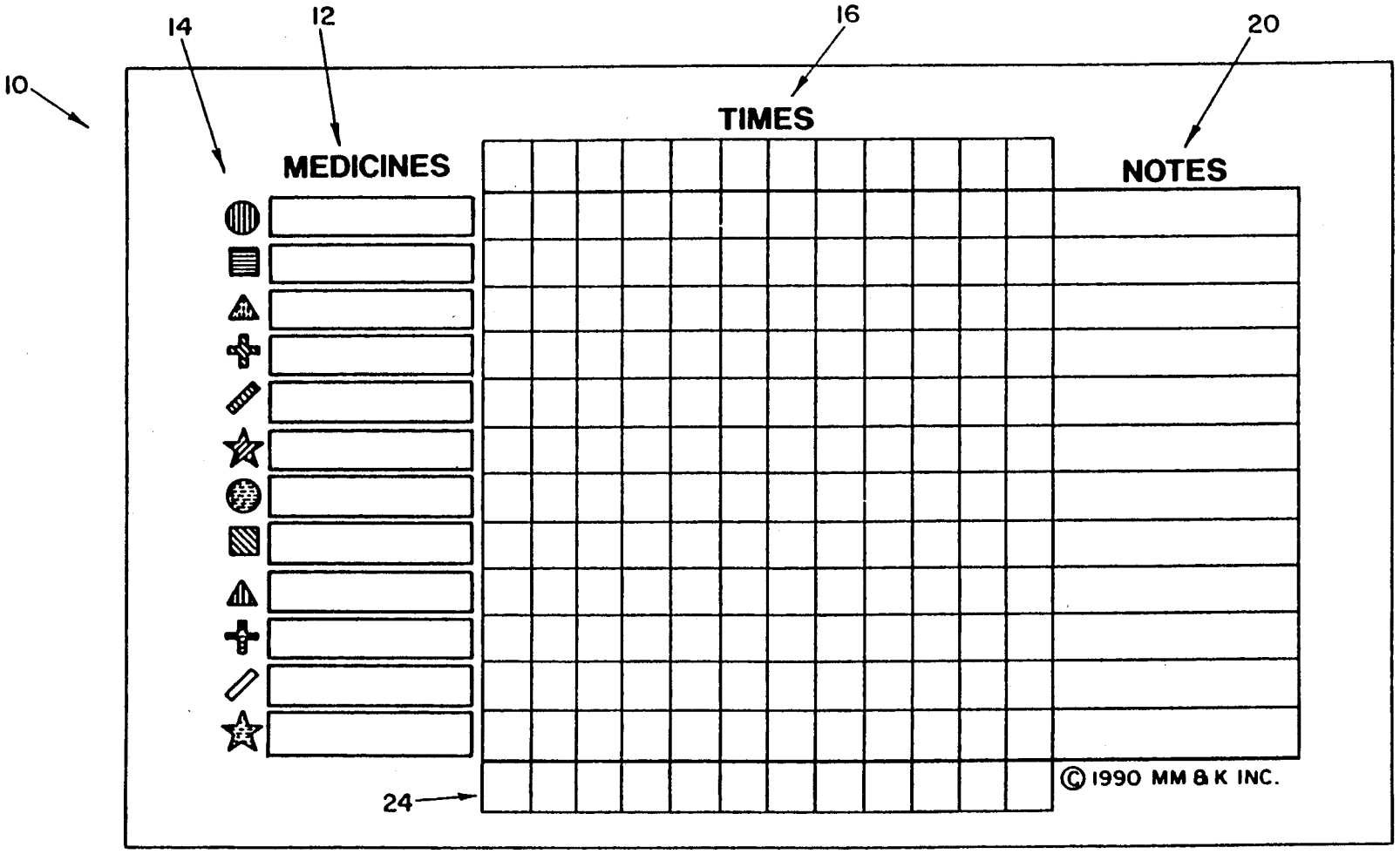
FIG. 1 illustrates a chart in accordance with the preferred embodiment of the invention.

As shown in FIG. 1, the preferred embodiment of the invention comprises chart 10. This chart 10 may be laminated (e.g., for magnetic attachment), or made of plastic, cloth, paper and the like. In the preferred embodiment, the chart 10 is made of a material, such as ferrous sheet metal, which allows magnetic attachment of medication marking elements (described below). Such an embodiment may comprise a laminate, with a smooth outer or uppermost surface, such as a plastic surface, and a metal backing or metal inner layer. Alternatively, the bottommost or backing layer of chart 10 comprises magnetic material, for instance magnetized ferromagnetic particles in a plastic binder (e.g., PLASTIFORM®, manufactured by 3M, and ULTRA MAG®, distributed by Flexmag Industries, Adams Magnetic Product of Chicago, Illinois, and Magna Products of Grafton, Ohio). Such structure provides attachment to ferromagnetic surfaces, such as refrigerators, steel cabinets, and the like, as well as attracting magnetic medication marking elements. Alternatively, the backing layer may comprise unmagnetized ferromagnetic particles or sheet; such structure would necessarily require other attachment or suspension devices. In yet another alternative embodiment, the backing layer comprises a relatively rigid metallic magnetic sheet.

The uppermost layer or surface of chart 10 preferably comprises a plastic material. Such plastic provides a receptive and easily erasable surface for marks made by marking pencils or pens, including Magic Markers®, "grease" pencils, and the like. The plastic surface further provides a surface upon which the medication marking elements are directly positioned.

Figure 2:
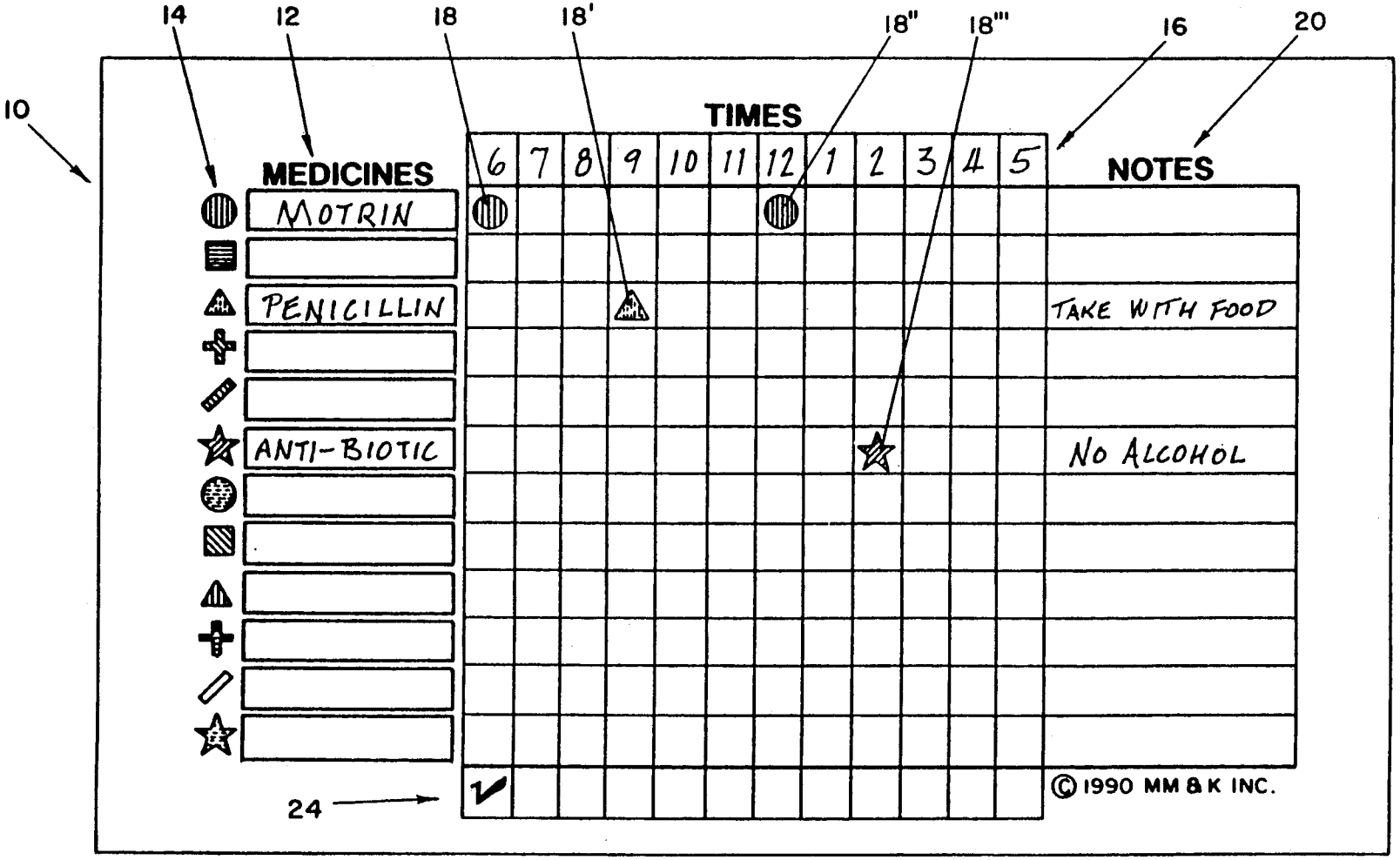
FIG. 2 depicts the chart of FIG. 1 with medication markers, times, and notes thereon.

The uppermost surface of the chart 10 (or uppermost layer beneath a clear surface plastic layer in a laminated embodiment) preferably comprises a multicolored (preferably at least four colors and most preferably at least eight colors) informational card comprising horizontal rows and vertical columns. This informational surface also comprises a multiplicity of information areas thereon, as follows:

(1) The chart 10 comprises a "Medicines" column 12 in which each medication (e.g., "Motrin," "Penicillin," and "Anti-Biotic" designations shown in FIG. 2) is recorded in the columnar boxes 12 provided. Adjacent each medication (in column 12) is its associated color-coded and shaped symbol 14. Each columnar box 12 containing the recorded medications may be outlined in its associated color to further emphasize this color. The medicine names or trademarks are preferably entered with an erasable marking pen or pencil so that the entry can be changed if the patient's medications are changed.

(2) The chart 10 further comprises a "Times" section 16 (the uppermost row of the chart 10) wherein the appropriate daily dosage times are recorded (such as shown in FIG. 2), preferably with erasable marking pencils or pens so that the times can be erased and changed upon the doctor's orders.

Medication marking elements 18, 18', 18'', and 18''' (hereinafter designated as 18), including magnets, tacks, pins, marks made by colored marking pencils and pens, and the like, are disposed or positioned on the chart 10, such as shown in FIG. 2. The preferred medication marking elements 18 are colored raised symbols mounted on a magnet or magnetic material. The medication marking elements 18 correspond to the identical color coded symbols 14 on chart 10 denoting the medications. Depending upon the chart backing, such magnetic material may comprise permanent magnets, such as Plastiform® magnets, ceramic magnets, alnico, or the like, or unpolarized ferromagnetic material.

Chart 10 provides a reminder to take only the prescribed medications at the proper time, matching colored shaped tabs (e.g., stickers 22 shown in FIG. 7) disposed on corresponding medication containers (see FIGS. 4–6) to the colored shaped marking elements 18 and symbols 14 on the chart 10.

The use of colored symbols 14 and raised medication marking elements 18 on the chart 10 provides tactile as well as visual identification of the various medications. The onset of the aging process is frequently accompanied by reduced visual acuity. Identification of medication marking elements 18 by feel or touch provides an additional identificational safeguard. Similarly, patients afflicted with color blindness would also benefit from this additional identification device.

Chart 10 may further comprise a "Notes" section 20 to provide general information regarding the various medications 12, such as specific dosages, side effects, and precautions (e.g., "Take with food" or "No alcohol," as shown in FIG. 2).

Chart 10 may also further comprise a checkmark section 24 to provide a reminder to check the appropriate box in this bottommost row of the chart 10 with preferably an erasable marking pencil or pen after the corresponding medication 12 has been taken by the patient at the designated time 16, as shown by the medication marking elements 18.

Likewise, an "end-of-day" reminder, "change of medication" reminder, and the like, may be provided on chart 10 to provide further assistance in the management of the patient's medicines.

FIG. 2 depicts chart 10 as it might appear in use. Daily dosage times have been written in the "Times" section 16. Medication marking elements 18 coded to specific medications 12 and medication symbols 14 are affixed to chart 10 in the proper dosage time columns beneath the "Times" row 16. Appropriate notes regarding the specific medications are recorded in the "Notes" section 20.

After setting up the chart 10 reflecting a specific day of medication, the patient need only take the prescribed medication 12 at the prescribed time 16, duly noting the precautions in the "Notes" section 20. Thereafter, a check is registered in the box at the bottom of that particular section 24. At the end of the day, all check marks are erased, which prepares the chart 10 for the following day.

Figure 3:
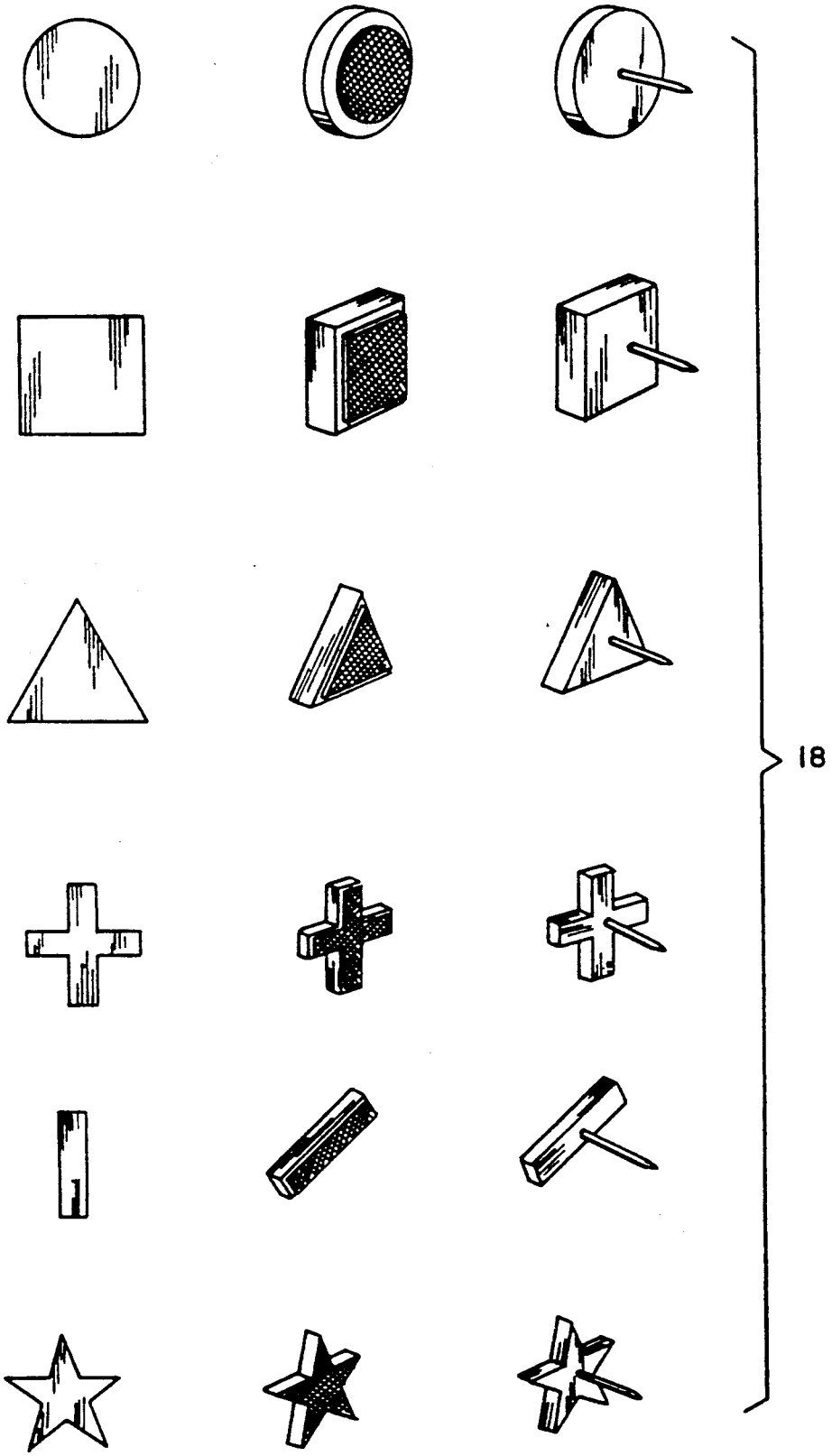
FIG. 3 depicts marking symbols applied to flat markers, magnets and tacks.

FIG. 3 illustrates some components provided with the chart, useful in the kit of the invention. Such kit comprises the chart 10 itself (see FIGS. 1 and 2), various medication marking elements 18 (see FIG. 3), medication container marking tabs 22 (see FIG. 7), marking pencils or pens (see FIG. 8) and a sponge eraser (see FIG. 9).

As shown in FIG. 3, the preferred kit of the invention preferably comprises a plurality of medication marking elements 18, which may be flat or preferably raised, preferably containing a magnet or magnetic material, being colored to correspond to the symbols 14 on the chart 10. Appropriate shapes include, but are not limited to circles, squares, triangles, crosses, diamonds, rectangles, and stars, for example, having varying colors. Any distinctive and viable combination of number of elements 18, shapes, and colors may be provided. While various colors and shapes may be replicated for different daily dosage times of the same medication, under no circumstances is a particular colored symbol duplicated in use for different medications. As noted previously, the use of raised symbols is preferred as providing tactile identification. Such is not necessary, however, and the appropriate symbol may merely be inscribed or otherwise planiformly outlined on the chart 10. Further, colors alone or symbols alone, raised or planar, may be provided to code elements 18 to medications.

Similar considerations apply to the use of tacks, also shown in FIG. 3, provided as medication marking elements 18. Such tacks may comprise raised colored symbols on the heads thereof. Further, the tacks may comprise only coded colors, or plain symbols outlined on the tack heads. Being self-adhesive, tacks are relatively inexpensive and do not require a magnetic chart backing. Otherwise, their use is substantially the same as the use of magnetic elements. The same constraint applies: tacks of identical shape and color must not be used to denote different medications.

Figure 8:
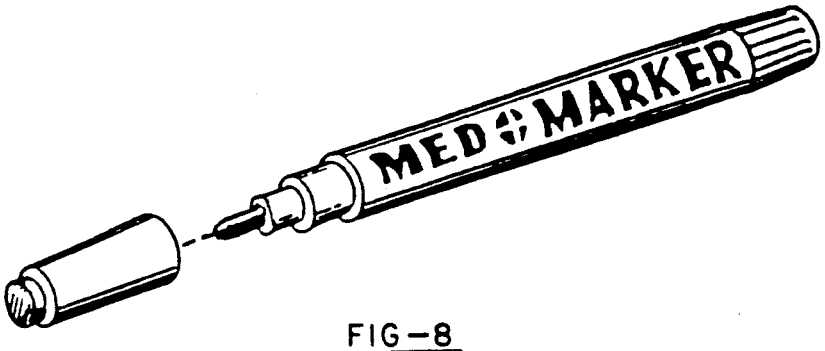
FIG. 8 illustrates a colored marking pen or pencil used with the invention.

Colored marking pencils alone, depicted in FIG. 8, may be used to represent and correspond to the various medications 12 on chart 10. Elements 18 may or may not be drawn on the chart 10; as with magnets and tacks, color coding alone may be sufficient representation of a particular medication 12.

The kit may further comprise a plurality of colored pins as medicine marking elements 18. The pins are color coded to correspond with specific medications 12. Again, identically colored pins must not be used to denote different medications.

Figure 4:
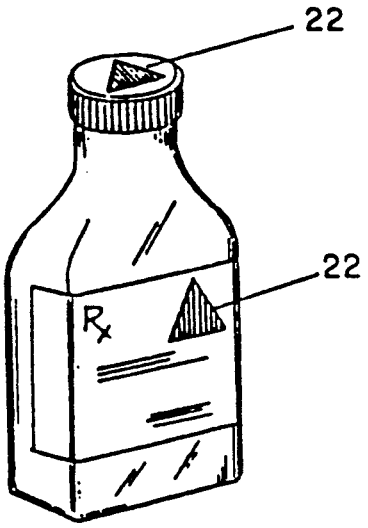
FIG. 4 illustrates tabs marking a medication bottle.
Figure 5:
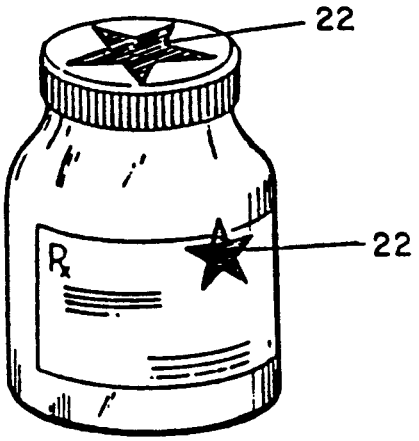
FIG. 5 illustrates tabs marking another medication bottle.
Figure 6:
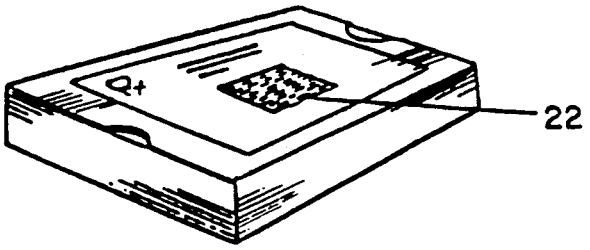
FIG. 6 shows tabs marking a box which might contain a medicated patch.
Figure 7:
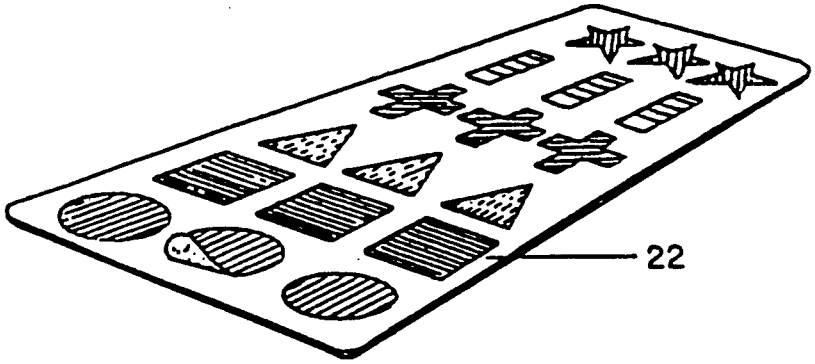
FIG. 7 shows adhesive tabs disposed on a backing paper.

The kit also comprises a plurality of medication container markers 22, as shown in FIGS. 4–7. Preferably, such markers comprise adhesive tabs. Such markers 22 correspond identically in shape and color to the medication marking elements 18 and symbols 14 on chart 10 to denote particular medications 12. Each prescribed medication container (see FIGS. 4–6) is provided with an adhesive tab or tabs 22 of a particular shape and color. Also, as with the medication marking elements 18, symbol shape alone or color alone may be provided on the adhesive tabs 22 to code the particular medication. Although FIGS. 4 and 5 show tabs 22 disposed on both the lids and bodies of the medication containers, lids might be lost or switched, so it is best to position these tabs 22 at least on the bodies of the medication containers.

Figure 9:
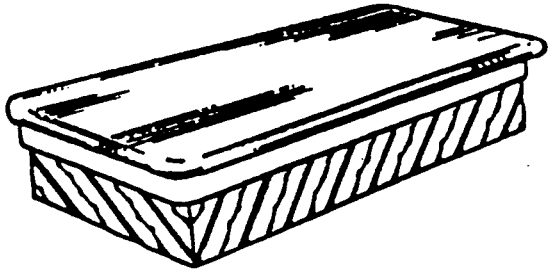
FIG. 9 shows a sponge eraser used with the invention.

The kit further provides an eraser sponge, depicted in FIG. 9, by which marking pencil or pen notations may be erased on the chart 10.

The present invention may be utilized in connection with another chart, which provides space for the name of each drug and what it is for; a description of the drug (its shape, color, etc.)., directions for taking the medication (e.g., number of times daily, during or after meals) and any cautions or side effects; and the actual time of day to take the medication, based on the directions.

The chart 10 may be of various sizes. Larger dimensions (e.g., 16"×18") are useful for the visually impaired or when a large number (e.g., six to twelve)

medications are being taken by a patient. Smaller embodiments (e.g., 9"×12") are useful for fewer medications or for hanging or attachment to a limited space.

An even smaller, portable embodiment of the invention (e.g., $4\frac{1}{4}$"×6") conveniently fits in purse or pocket and also into the medicine carrier listed in the American Association of Retired Persons (AARP) Prescription Catalog. This portable chart also has the capability of keeping track of multiple medications. Instructions, which can be placed on the back of the chart, enable the carrier to see at a glance which medicines are to be taken and to check them off with a dry marker after doing so.

Yet another embodiment provides an electronic version of the chart. The electronic embodiment comprises a keypad, clock, calendar, calculator, and memory. A system of blinking lights and audible alarms keyed to the chart symbols of specific medications indicate when dosage of a specific medication is scheduled. After taking the prescribed dosage, the indicators are suppressed by depressing a button indicating the dosage has been taken. Reset of the device is automatic.

With the variations in drug regimens and lifestyles today, it is important that a practical system for managing multiple medications be implemented. The system of the present invention can help the patient take medicines properly and at the correct time. It can aid in avoiding confusion when keeping track of numerous medicines, including over the counter drugs, becomes cumbersome. It can help the patient to remember by visual display, which can be color coded, whether or not and indeed which, medicines have already been taken. A bold and easily readable color coded display can also help the patient to understand instructions without the need to read the small print on prescription container labels. The system saves time and anxiety not only for the patient, but for caregivers in that it allows quick and easy to follow chart adjustments. The system can be an aid to any skilled professional who administers the multiple drug regimen to a patient. It is clearly useful in the home, as well as in hospitals and nursing facilities as it (1) serves to keep track of multiple medications; (2) serves as a reminder to take the proper dosage when required, (3) aids in understanding each medication's accompanying instructions., and (4) clearly shows whether or not the drug has already been taken.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A daily medication management system comprising a daily chart, said daily chart comprising:

means for removably marking names of medicines to be taken by a patient;

movable coded symbol means corresponding to the medicines to be taken by the patient;

means for removably marking the times of the day for the medicines to be taken by the patient;

movable medication marking elements disposed on said chart, said medication marking elements corresponding to said coded symbol means and positionable on said daily chart in such a manner to indicate the time of the day at which the medicines are to be taken by the patient;

an uppermost laminated sheet comprising a clear plastic surface providing means for marking and changing said times of the day for the medicines to be taken by the patient and for positioning said coded symbol means on said daily chart;

the sheet underlying said clear plastic surface comprising rows and columns for marking said names of medicines to be taken by the patient, and for said marking times of the day for the medicines to be taken by the patient and for said positioning of said coded symbol means on said clear plastic surface sheet; and a layer comprising magnetic material.

2. The invention of claim 1 wherein said coded symbol means comprise distinctive varying shapes for designating corresponding various medicines to be taken by the patient.

3. The invention of claim 2 wherein said coded symbol means are coded via varying shapes selected from the group consisting of circles, squares, triangles, diamonds, crosses, rectangles, and stars.

4. The invention of claim 2 wherein each said medication marking element is substantially identical in shape to its corresponding coded symbol means for designating each particular medicine to be taken by the patient.

5. The invention of claim 1 wherein said coded symbol means are coded via varying colors for designating various medicines to be taken by the patient.

6. The invention of claim 5 wherein each said medication marking element is substantially identical in color to its corresponding coded symbol means for designating each particular medicine to be taken by the patient.

7. The invention of claim 1 wherein said medication marking elements comprise pin means.

8. The invention of claim 1 wherein said medication marking elements comprise marks made by marking pencils or pens.

9. The invention of claim 1 wherein said medication marking elements comprise magnetic marker means.

10. The invention of claim 1 wherein said medication marking elements comprise tack means.

11. The invention of claim 1 wherein said medication marking elements comprise raised elements.

12. The invention of claim 1 wherein said coded symbol means and said medication marking elements comprise corresponding varying distinctive shapes and colors to designate the various medicines to be taken by the patient.

13. The invention of claim 12 wherein said coded symbol means and said medication marking elements are coded via varying shapes selected from the group consisting of circles, squares, triangles, diamonds, crosses, rectangles, and stars.

14. The invention of claim 1 wherein said chart further comprises means for recording information pertaining to the various medicines to be taken by the patient.

15. The invention of claim 1 wherein said bottom layer of magnetic material comprises magnetized ferromagnetic particles in a plastic binder.

16. The invention of claim 1 wherein said bottom layer of material comprises unmagnetized ferromagnetic particles in a plastic binder.

17. The invention of claim 1 wherein said laminated chart comprises a relatively rigid ferromagnetic sheet layer.

18. The invention of claim 1 wherein said laminated chart is flexible.

19. The invention of claim 1 wherein said coded symbol means are positioned adjacent said names of medicines marked on said chart.

20. The invention of claim 1 wherein said means for marking times of the day for the medicines to be taken by the patient comprises use of marking pens or pencils.

21. The invention of claim 1 wherein said means for marking times of the day for the medicines to be taken by the patient comprises numerals printed on said chart.

22. The invention of claim 1 wherein five or more medication marking elements are positionable at a single time of the day on said daily chart.

23. The invention of claim 1 wherein said medication marking elements are removably attachable to said chart.

24. The invention of claim 23 wherein said medication marking elements are erasable marks made by the marking pen or pencil.

25. The invention of claim 1 wherein said means for marking names of medicines to be taken by the patient comprises use of marking pens or pencils.

26. The invention of claim 25 wherein said marking pens or pencils are color coded.

27. A medication management kit comprising:

a daily chart, said daily chart comprising means for removably marking names of medicines to be taken by a patient, movable coded symbol means corresponding to the medicines to be taken by the patient, means for removably marking times of the day for the medicines by the patient;

movable medication marking elements disposed on said daily chart, said medication marking elements corresponding to said coded symbol means and positionable on said daily chart in such a manner to indicate the time of the day at which the medicines are to be taken by the patient;

tab means for marking medication containers, said tab means corresponding to said coded symbol means and said medication marking elements;

an uppermost laminated sheet comprising a clear plastic surface providing means for marking and changing said names of medicines to be taken by a patient and for marking and changing said times of the day for the medicines to be taken by the patient and for positioning said coded symbol means on said daily chart;

the sheet underlying said clear plastic surface comprising rows and columns for marking said names of medicines to be taken by the patient, for said marking times of the day for the medicines to be taken by the patient and for said positioning of said coded symbol means on said clear plastic surface sheet; and a layer comprising magnetic material.

28. The invention of claim 27 wherein said coded symbol means are coded via varying colors for designating various medicines to be taken by the patient.

29. The invention of claim 27 wherein said medication marking elements comprise pin means.

30. The invention of claim 27 wherein said medication marking elements comprise marks made by marking pencils or pens.

31. The invention of claim 27 wherein said medication marking elements comprise magnetic marker means.

32. The invention of claim 27 wherein said medication marking elements comprise tack means.

33. The invention of claim 27 wherein said medication marking elements comprise raised elements.

34. The invention of claim 27 wherein said chart further comprises means for recording information pertaining to the various medicines to be taken by the patient.

35. The invention of claim 27 wherein said bottom layer of magnetic material comprises magnetized ferromagnetic particles in a plastic binder.

36. The invention of claim 27 wherein said bottom layer of magnetic material comprises unmagnetized ferromagnetic particles in a plastic binder.

37. The invention of claim 27 wherein said laminated chart comprises a relatively rigid ferromagnetic sheet layer.

38. The invention of claim 27 wherein said laminated chart is flexible.

39. The invention of claim 27 wherein said medication marking elements are removably attachable to said chart.

40. The invention of claim 27 wherein said tab means are adhesive tabs.

41. The invention of claim 40 wherein said coded symbol means are coded via varying shapes selected from the group consisting of circles, squares, triangles, diamonds, crosses, rectangles, and stars.

42. The invention of claim 40 wherein each said medication marking element is substantially identical in shape to its corresponding coded symbol means for designating each particular medicine to be taken by the patient.

43. The invention of claim 40 wherein each said tab means is substantially identical in shape to its corresponding coded symbol means and said medication marking element for designating each particular medicine to be taken by the patient.

44. The invention of claim 27 further comprising at least one marking pen or pencil for marking at least one of said names of medicines to be taken by the patient, said coded symbol means, said times of the day, and said medication marking elements.

45. The invention of claim 44 further comprising sponge means for erasing said marks.

46. The invention of claim 27 wherein said coded symbol means comprise distinctive varying shapes for designating corresponding various medicines to be taken by the patient.

47. The invention of claim 46 wherein each said medication marking element is substantially identical in color to its corresponding coded symbol means for designating each particular medicine to be taken by the patient.

48. The invention of claim 46 wherein each said tab means is substantially identical in color to its corresponding coded symbol means and said medication marking element for designating each particular medicine to be taken by the patient.

49. The invention of claim 27 wherein said coded symbol means, each said medication marking elements, and each said tab means comprise corresponding varying distinctive shapes and colors to designate the various medicines to be taken by the patient.

50. The invention of claim 49 wherein said coded symbol means, said medication marking elements, and said tab means are coded via varying shapes selected from the group consisting of circles, squares, triangles, diamonds, crosses, rectangles, and stars.

51. The invention of claim 27 wherein said means for marking names of medicines to be taken by the patient comprises use of marking pens or pencils.

52. The invention of claim 51 wherein said medication marking elements are erasable marks made by the marking pen or pencil.

53. The invention of claim 51 wherein said marking pens or pencils are color coded.

54. The invention of claim 27 wherein said coded symbol means are positioned adjacent said names of medicines marked on said chart.

55. The invention of claim 27 wherein said means for marking times of the day for the medicines to be taken by the patient comprises use of marking pens or pencils.

56. The invention of claim 27 wherein said means for marking times of the day for the medicines to be taken by the patient comprises numerals printed on said chart.

57. A daily medication management system comprising a daily chart, said daily chart comprising:

means for removably marking names of medicines to be taken by a patient in a single day only;

movable coded symbol means disposed on said chart corresponding to the medicines to be taken by the patient in the single day;

means for removably marking times of the day of the single day for the medicines to be taken by the patient;

means for removably marking notes about the medicines to be taken by the patient in the single day; and movable medication marking elements in addition to said movable coded symbol means, said movable medication marking elements disposed on said chart and said medication marking elements corresponding to said coded symbol means and positionable on said daily chart in such a manner to indicate the time of the day in the single day at which the medicines are to be taken by the patient;

an uppermost laminated sheet comprising a clear plastic surface providing means for marking and changing said names of medicines to be taken by a patient and for marking and changing said times of the day for the medicines to be taken by the patient and for positioning said coded symbol means on said daily chart; and the sheet underlying said clear plastic surface comprising rows and columns for marking said names of medicines to be taken by the patient, and for said marking times of the day for the medicines to be taken by the patient and for said positioning of said coded symbol means on said clear plastic surface sheet.

58. The invention of claim 57 further comprising tab means for marking medication containers, said tab means corresponding to said coded symbol means and said medication marking elements.

59. The invention of claim 57 wherein five or more medication marking elements are positionable at a single time of the day on said daily chart.

* * * * *